US010709957B1

(12) United States Patent
Chen

(10) Patent No.: US 10,709,957 B1
(45) Date of Patent: Jul. 14, 2020

(54) LOOSENING-RESISTANT BLADE MOUNTING BRACKET FOR ICE SKATES

(71) Applicant: Jian Chen, Colorado Springs, CO (US)

(72) Inventor: Jian Chen, Colorado Springs, CO (US)

( * ) Notice: Subject to any disclaimer, the term of this patent is extended or adjusted under 35 U.S.C. 154(b) by 0 days.

(21) Appl. No.: 16/270,899

(22) Filed: Feb. 8, 2019

Related U.S. Application Data

(60) Provisional application No. 62/711,517, filed on Jul. 28, 2018.

(51) Int. Cl.
*A63C 1/02* (2006.01)

(52) U.S. Cl.
CPC ..... *A63C 1/02* (2013.01)

(58) Field of Classification Search
CPC ..... A63C 1/02
See application file for complete search history.

(56) References Cited

U.S. PATENT DOCUMENTS 2,103,128 A * 12/1937 Walter ..... B65F 3/207 414/525.52
2,150,964 A * 3/1939 Dornseif ..... A63C 1/30 280/11.18
2,230,553 A 2/1941 Weisman
4,323,259 A 4/1982 Boudreau
4,353,562 A 10/1982 Tiefenthal
5,088,749 A * 2/1992 Olivieri ..... A63C 1/20 280/11.18
5,505,467 A * 4/1996 Hill ..... A63C 1/26 280/11.12
5,988,683 A * 11/1999 Venier ..... A63C 1/30 280/841
6,039,328 A 3/2000 Pawlowski et al.
6,109,622 A 8/2000 Reynolds
7,243,924 B2 7/2007 Dahlo et al.
7,758,053 B2 * 7/2010 Wylie ..... A63C 1/32 280/11.12
8,056,907 B2 * 11/2011 Wilson ..... B24B 3/003 280/11.12
9,186,596 B2 * 11/2015 Hay ..... B01D 1/065
D835,740 S * 12/2018 Daoust ..... D21/761
10,195,514 B2 * 2/2019 Davis ..... A63C 1/303
10,335,925 B2 * 7/2019 Layton, Jr. ..... B24B 9/04

* cited by examiner

*Primary Examiner* — John D Walters
*Assistant Examiner* — James J Triggs
(74) *Attorney, Agent, or Firm* — Trenner Law Firm, LLC; Mark D. Trenner

(57) ABSTRACT

An example loosening-resistant blade mounting bracket for an ice skate includes a platform having one or more slot configured to receive a first fastener therethrough for attaching the platform to the bottom of a skate boot. One or more riser is provided substantially perpendicular on the platform. The riser has at least one opening configured to receive a second fastener therethrough for attaching the riser to a skate blade. A set screw may be provided on the at least one riser to tighten the riser against a mounting hump on the skate blade to reduce movement between the at least one riser and the mounting hump.

23 Claims, 9 Drawing Sheets

LOOSENING-RESISTANT BLADE MOUNTING BRACKET FOR ICE SKATES

CROSS REFERENCE TO RELATED APPLICATIONS

This application claims the priority benefit of U.S. Provisional Patent Application No. 62/711,517 filed Jul. 28, 2018 for "Loosening-resistant blade mounting bracket" of Jian Chen, hereby incorporated by reference in its entirety as though fully set forth herein.

BACKGROUND

A mounting bracket is provided to mount a skate blade to the boot of an ice skate. The mounting bracket is typically connected to the boot with a fastener provided through an oblong opening in the mounting bracket and threaded into an opening in the bottom of the boot. This design requires higher tolerance on machining both the mounting brackets and the skate blades, thus raising manufacturing costs. No matter how high the tolerance of manufacturing, there is always a gap between the mounting bracket legs and the mounting hump on the blade. This gap cannot be completely eliminated simply by tightening fasteners. Although this gap may be small, any gap can cause unnecessary vibrations which can consume energy of the skater.

DETAILED DESCRIPTION

Figure 1:
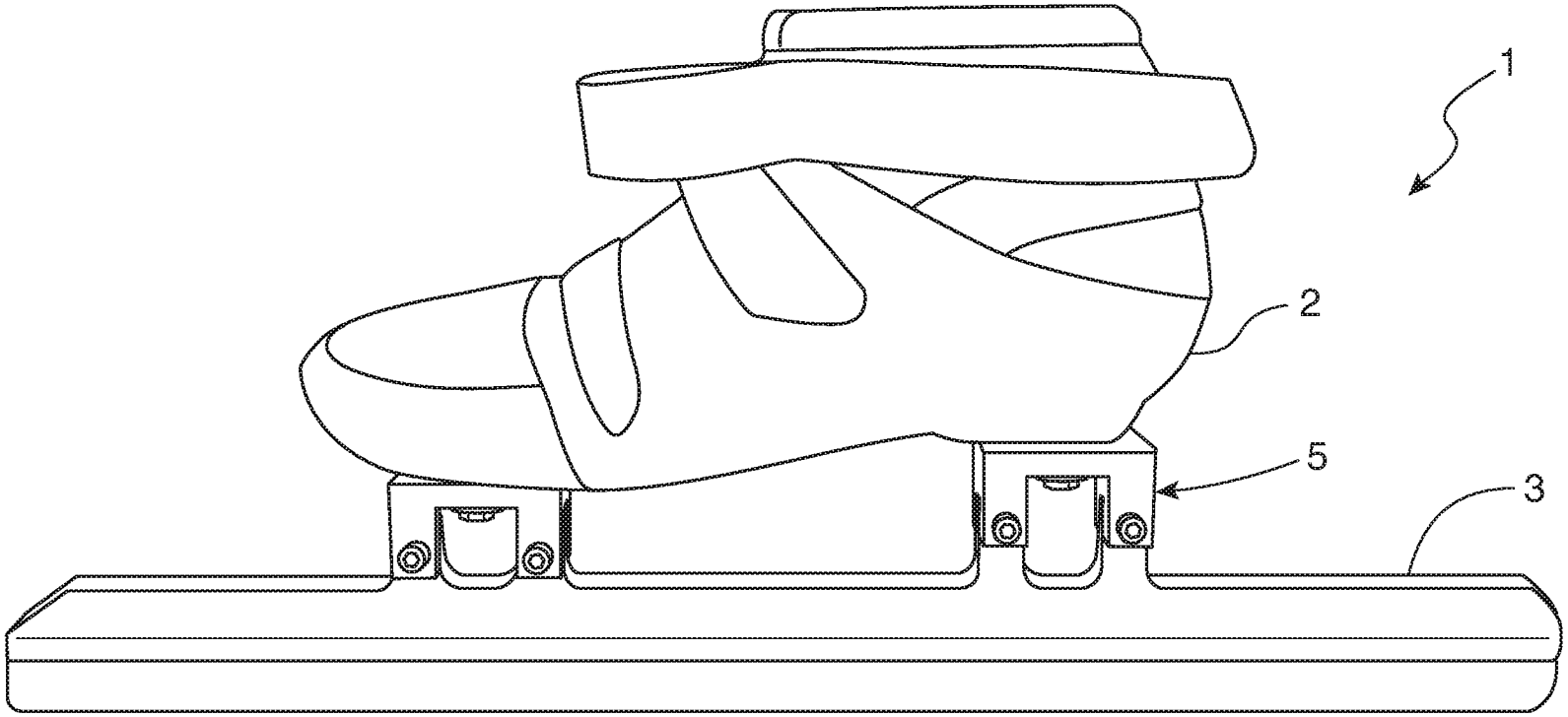
FIG. 1 Prior Art
FIGS. 1-3 show an example mounting bracket for an ice skate.
Figure 2:
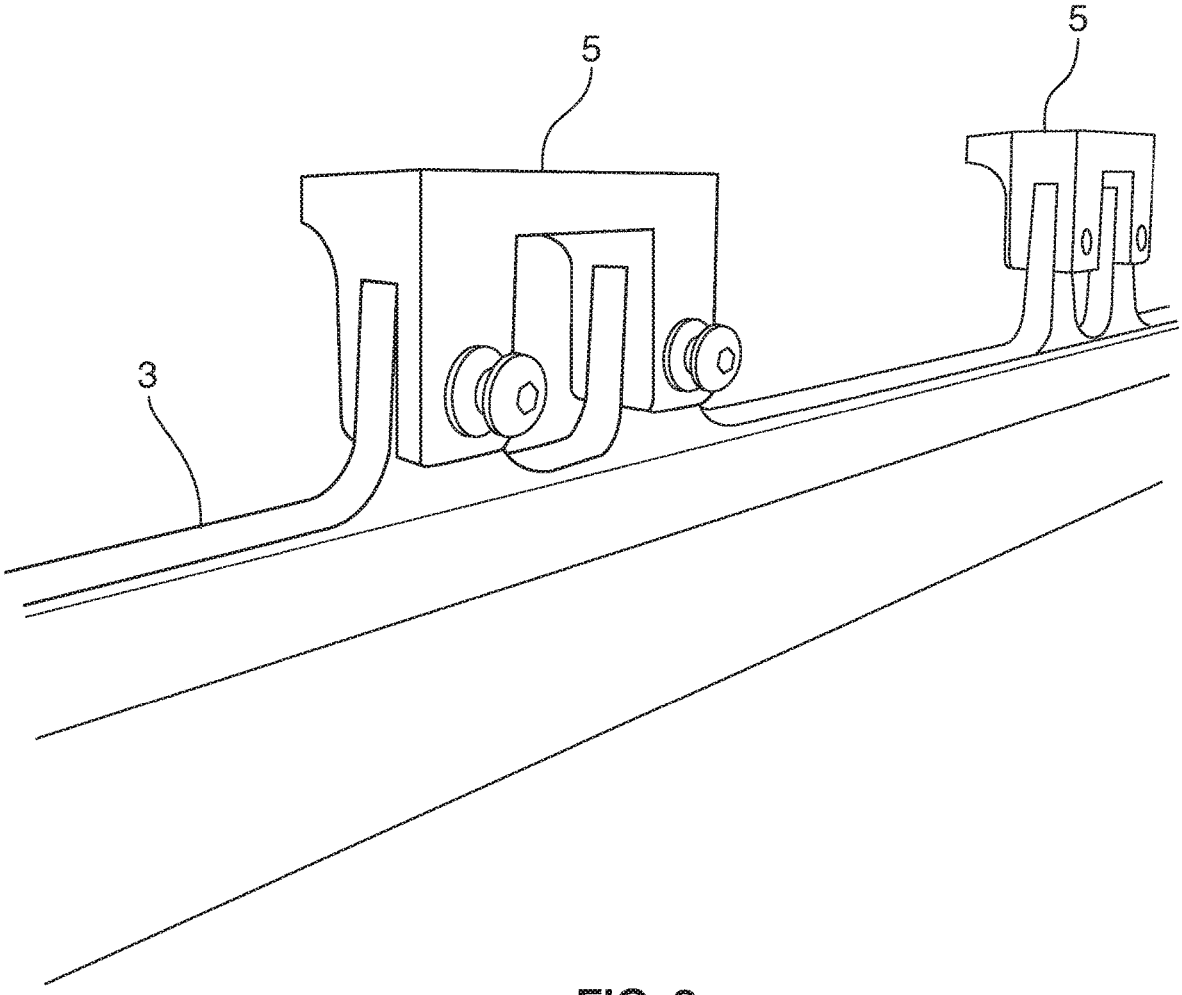
FIG. 2 Prior Art
Figure 3:
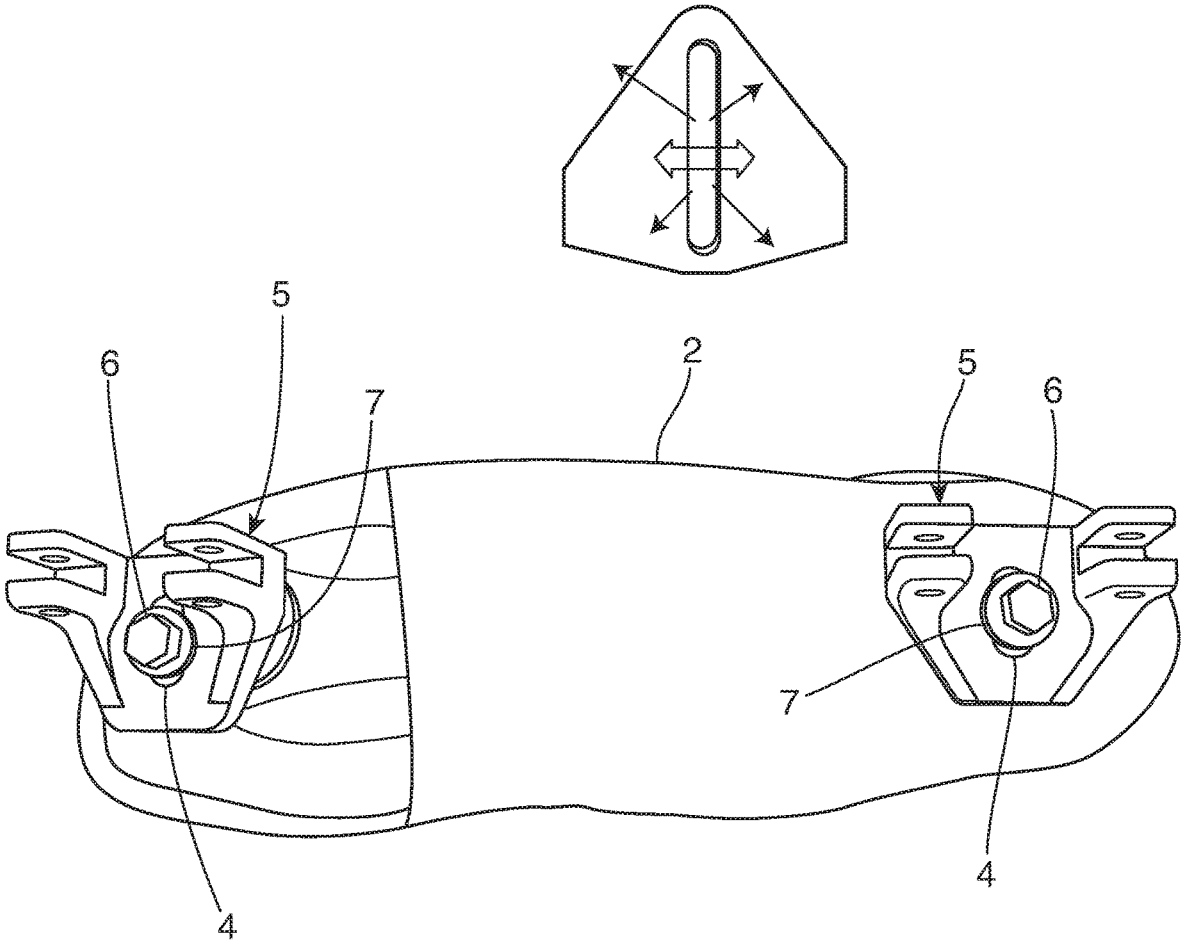
FIG. 3 Prior Art

Mounting brackets, also known as "mounting cups" in speed skating, are essential parts of ice skates to integrate skating blades and skating boots 3. FIGS. 1-3 show an example mounting bracket 5 for an ice skate 1. The mounting bracket 5 provides an interface between the skate boot 2, and the skate blade 3.

The mounting bracket 5 may be made of aluminum alloys and often has an oblong hole 4 (visible in FIG. 3) to host fasteners (e.g., bolts 6 and washers 7) for connecting to the underside of the skate boot 2. In an example, the width of the hole 4 is about 10 mm, which is about 5 mm more than the diameter of the mounting bolt 6. This gap not only results in ample space for the fasteners (e.g., the bolts 6) to wiggle and loosen, but also reduces the effective contact surface of the washers 7 with the mounting bracket 5, especially in the area closely surrounding the bolt. During use, the boot 2 can easily slide or skid under the stresses generated by skating motions, which compromises skating performances and damages ice rink surface.

A loosening-resistant blade mounting bracket is disclosed herein which realize adjustable and stable blade mounting, eliminate loosening and gap issues, comply with skating sport rules, and integrate with existing blades and boots without costly upgrading and manufacturer retooling.

Before continuing, it is noted that as used herein, the terms "includes" and "including" mean, but is not limited to, "includes" or "Including" and "includes at least" or "Including at least." The term "based on" means "based on" and "based at least in part on."

It is also noted that the term "ice skate" is used herein for purposes of illustration. The term "ice skate" is not intended to be limited to any particular type and/or style of ice skate. For example, the term "ice skate" may include recreational and professional ice skates, speed skates, racing skates, figure skates, hockey skates, bandy skates, touring skates, and double skates. Nor is the term "ice skate" Intended to limit use of the mounting bracket disclosed herein to ice skates. For example, the mounting bracket may also be provided for roller skates, roller blades, and various skateboards, snowboards, and other sports equipment. The mounting bracket may have application for any of a wide variety of other end-uses, as will be readily understood by those having ordinary skill in the art after becoming familiar with the teachings herein.

Figure 4:
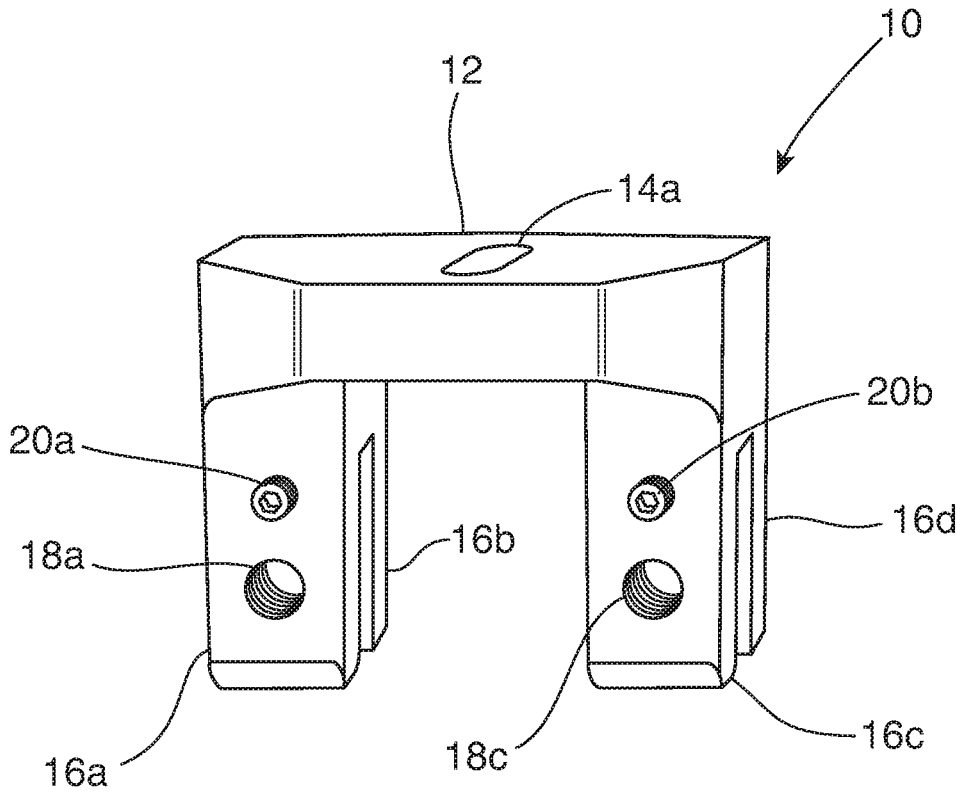
FIG. 4 is a perspective view of an example loosening-resistant blade mounting bracket.

FIG. 4 is a perspective view of an example loosening-resistant blade mounting bracket. In an example, the loosening-resistant blade mounting bracket 10 includes a platform 12. The mounting bracket 10 has at least one mounting leg or riser 12 configured to match the mounting mode of a skate blade. If no mounting legs are need for a particular blade, then the blade mounting bracket 10 can be configured block-like and mounting holes provided on sides of the mounting bracket.

In an example, the bracket 10 is four-legged with ride-on or female-male mounting mode. An example dimension of the bracket may be in the range of about 30 mm×30 mm×30 mm to 100 mm×100 mm×100 mm.

Figure 6A:
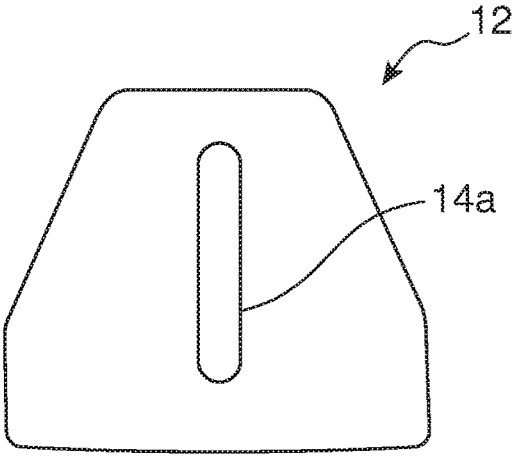
FIGS. 6A-D are top views showing example configurations of the example loosening-resistant blade mounting bracket shown in FIG. 4.
Figure 6B:
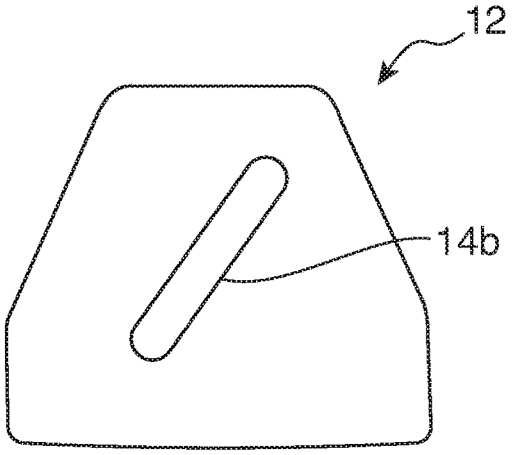
Figure 6C:
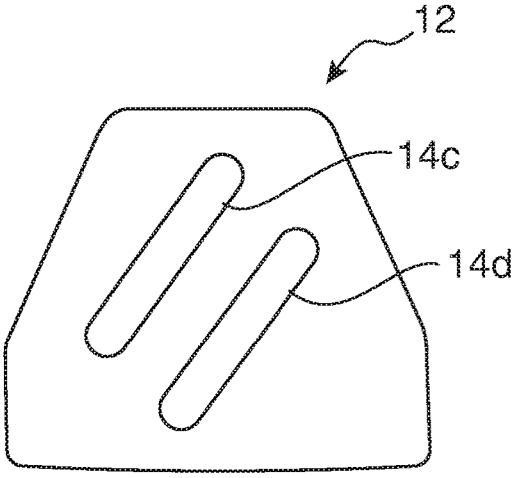
Figure 6D:
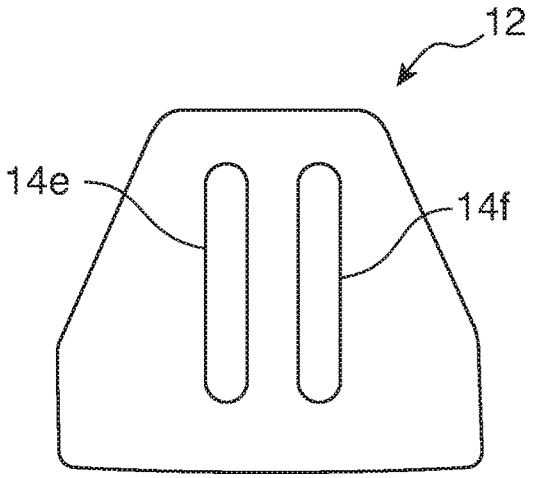
Figure 7:
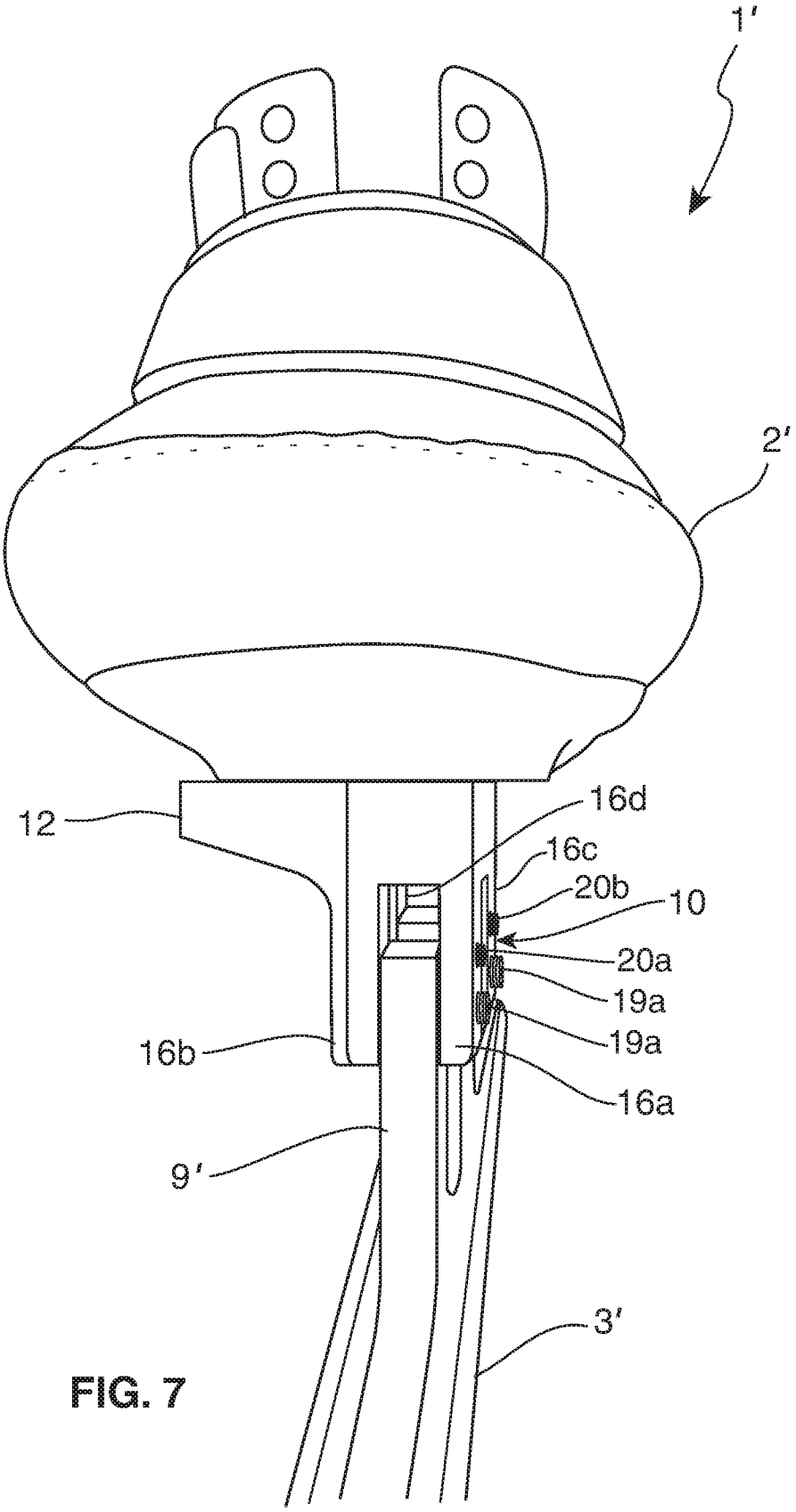
FIG. 7 is a front perspective view of an example loosening-resistant blade mounting bracket as it may be implemented with an ice skate.
Figure 8:
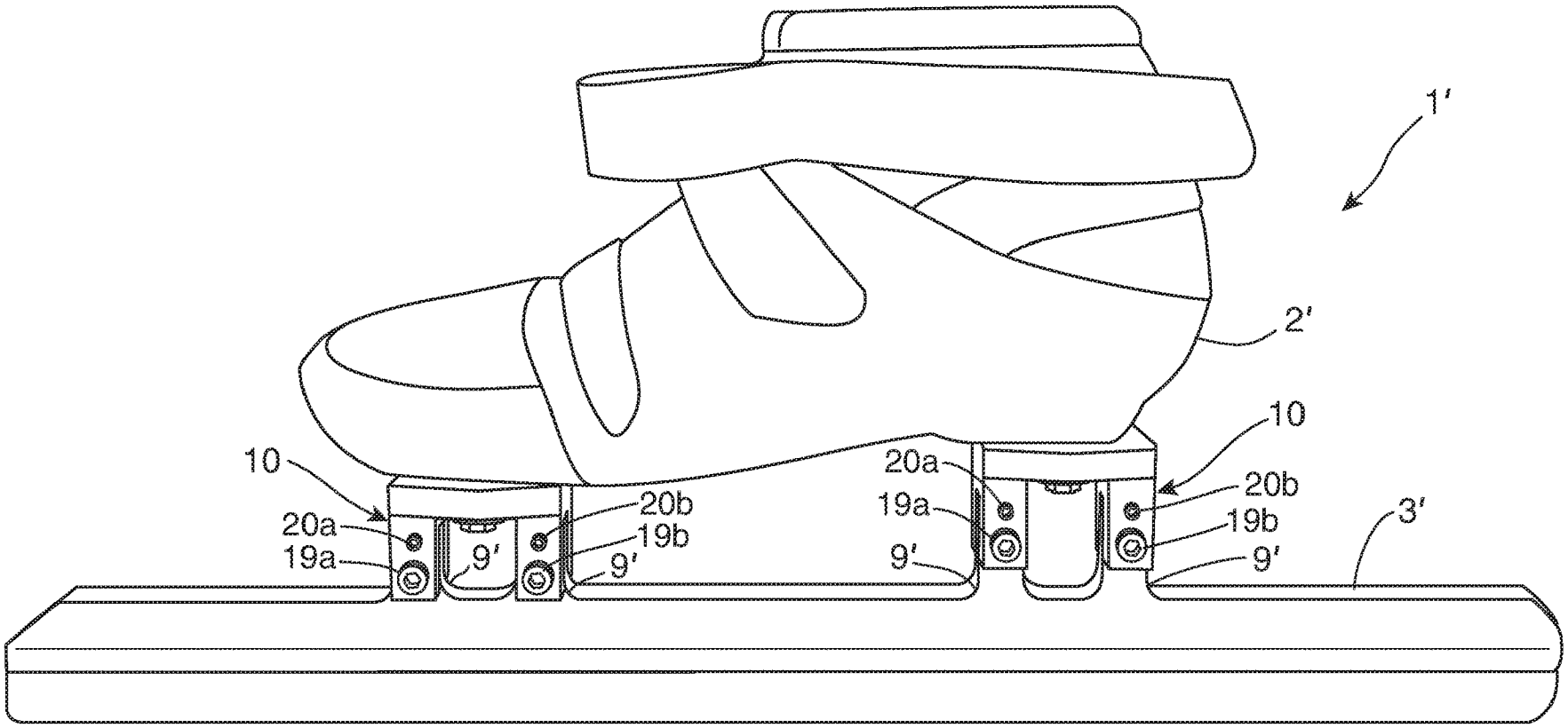
FIG. 8 is a side perspective view of an example loosening-resistant blade mounting bracket as it may be implemented with an ice skate.

One or more slot (see 14*a-f* in FIGS. 6A-6D) is formed through the platform 12. The slot is configured to receive a first fastener (e.g., a bolt) therethrough for attaching the platform 12 to the bottom of a boot 2' (e.g., as shown in FIGS. 7 and 8). At least one riser is provided on the platform 12 and at least one opening is formed through the at least one riser. The platform 12 of the loosening-resistant blade mounting bracket 10 is substantially perpendicular to the riser(s) 16*a-d*.

In the example shown in FIG. 4, four risers 16*a-d* are provided, each having corresponding openings 18*a-d* (only holes 18*a* and 18*c* are visible in FIG. 1). The openings 18*a-d* are configured to receive a fastener (e.g., a threaded bolt) therethrough for attaching the riser to a blade 3' (e.g., as shown in FIGS. 7 and 8).

In addition, the riser(s) may include an opening for a set screw. In FIG. 4, risers 16*a* and 16*c* have a corresponding set screw 20*a* and 20*b*. Other riser(s) (e.g., 16*b* and/or 16*d*) may also have set screw(s). The diameter of the setting hole may be about 2 to 5 mm. In an example, the diameter is 3 mm. The set screw can be tightened in the opening through the riser and against a mounting hump 9' (e.g., as shown in FIGS. 7 and 8) on the blade 3' to reduce movement between the attachment of the riser(s) and the mounting hump(s) 9'. More than one set screw may be provided on each riser.

The mounting bracket 10 can be made of any suitable material(s). Examples include uniformed solid or topologically optimized hollowed metals, metal alloys, metal composite materials, organic composite materials, carbon fibers, or combinations of these and/or other materials. In an example, the mounting bracket 10 is made of a solid alumina alloy.

The mounting bracket 10 can be made of printed materials, including metals, metal alloys, metal composite materials, organic composite materials, carbon fibers, or combinations of these and/or other materials. In an example, the mounting bracket 10 is made of a printed titanium alloy.

The printed material can be in uniform solid, three dimensionally latticed solid, or combinations of these and/or other forms.

In an example, the fasteners can be made of solid metal, metal alloys, metal composite material, organic composite materials, carbon fibers, or combinations of these and/or other materials. In an example, the fasteners are made of a steel alloy. The length and diameter of the fasteners for mounting boot and blade may vary according to the configurations of the bracket 10.

Figure 5A:
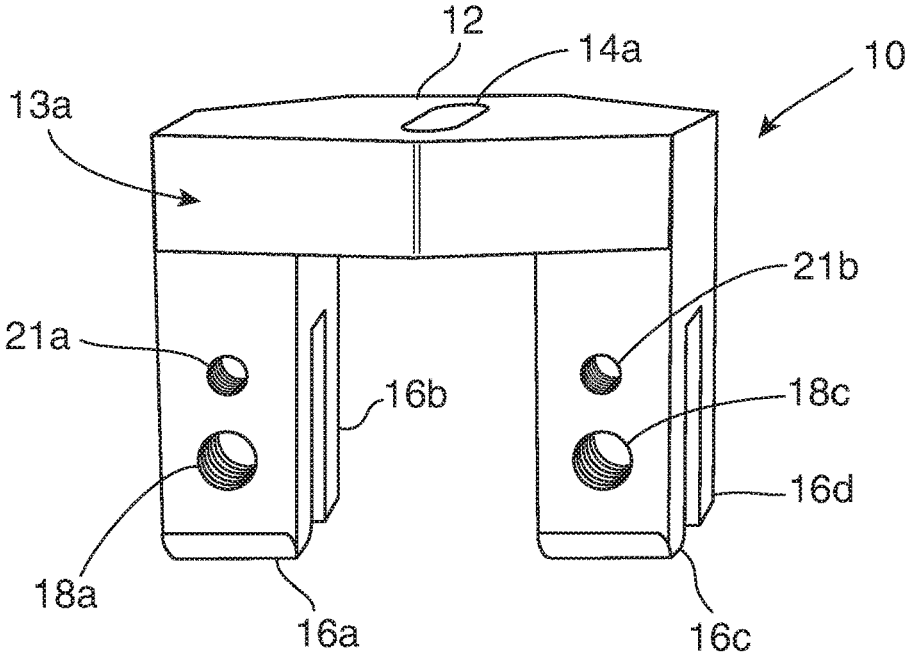
FIGS. 5A and 5B are perspective views of the loosening-resistant blade mounting bracket 10.
Figure 5B:
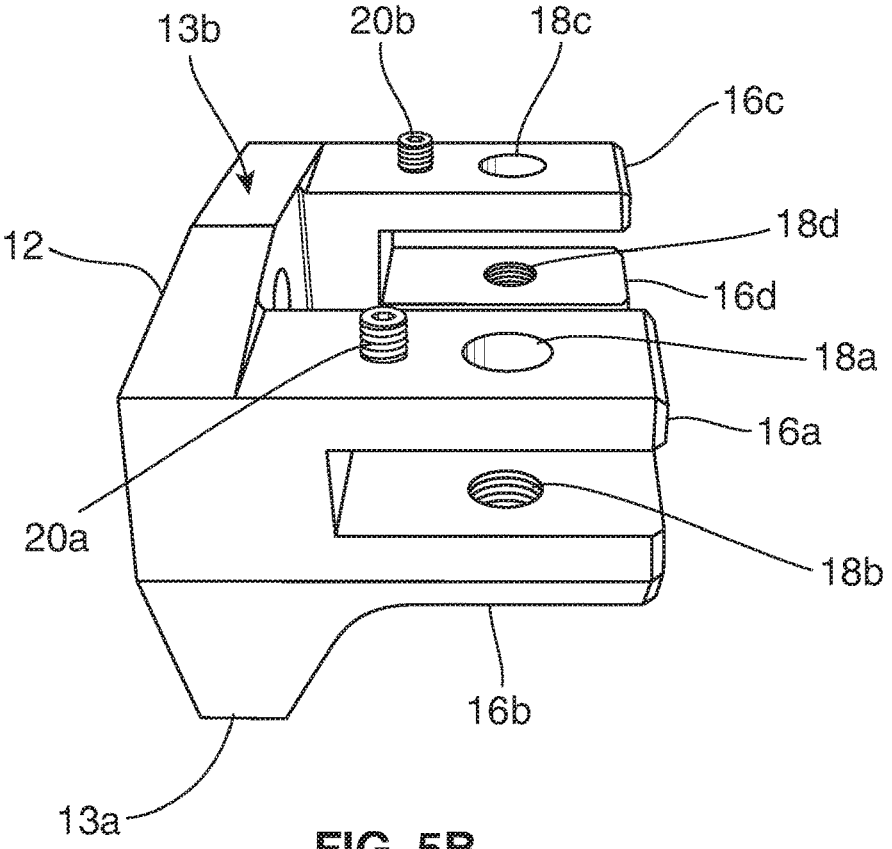

FIGS. 5A and 5B are perspective views of the loosening-resistant blade mounting bracket 10. The openings 21*a* and 21*b* are visible in FIG. 5A and the set screws 20*a* and 20*b* visible in FIG. 5B.

It is noted that the shape of the platform 12 is merely presented as example. Of course, other shape platforms, not shown, may also be provided, as will be readily understood by those having ordinary skill in the art after becoming familiar with the teachings herein FIGS. 6A-D are top views showing example configurations of the platform 12 of the example loosening-resistant blade mounting bracket 10 shown in FIG. 4. In an example, the mounting position of a skate blade 3' can be adjusted continuously, along the long sides of the slot hole 14*a-f*. The shape of the platform 12 of the mounting bracket 10 are not limited to trapezoidal, as shown. Other geometric shapes include but are not limited to square, half circle, diamond, triangle, rectangle, polygon, or any combinations of these or other shapes.

The slot(s) may have a reduced width to host a boot fastener. For example, the width of the bracket slot hole may be between about 3 and 7 mm. In an example, the width is 6.5 mm. The slot hole may extend along the central symmetric line, or angled to match the positions of the mounting holes on the boot. In an example, the reduced width restricts the movement of the fastener and provides mounting washer more effective working surface.

In an example, the platform 12 includes a slot 14*a* which is substantially perpendicular to a longitudinal direction of the blade 3' when the mounting bracket 10 is mounted as shown, e.g., in FIG. 7.

In another example, the slot 14*b* is diagonal relative to a longitudinal direction of the blade 3'. For example, the slot 14*b* may be formed substantially 45 degrees to a longitudinal direction of the blade. However, other angles are also contemplated.

In another example, more than one slot 14*c-d* is provided on the platform 12. Both slots shown in FIGS. 6C and 6D on the platform 12 substantially parallel to one another. In FIG. 6C, the slots 14*c-d* are diagonal (e.g., at about 45 degrees) to a longitudinal direction of the blade. In FIG. 6D, the slots 14*e-f* are perpendicular to a longitudinal direction of the blade. However, other angles are also contemplated.

In an example, the slot hole can be installed on the mounting brackets with any skate-bracket mounting modes, such as but not limited to, single leg bracket with male-female (or insert) mounting, two-leg bracket with female-male (or ride-on) mounting, and stacking blocks mounting, as long as the slot hole is the component for fastener installation.

In an example, the slot holes can be optionally recessed.

Before continuing, it should be noted that the examples described above are provided for purposes of illustration, and are not intended to be limiting. Other devices and/or device configurations may be utilized to carry out the operations described herein.

FIG. 7 is a front perspective view of an example loosening-resistant blade mounting bracket 10 as it may be implemented with an ice skate 1'. FIG. 8 is a side perspective view of an example loosening-resistant blade mounting bracket 10 corresponding to FIG. 7, as the bracket(s) 10 may be implemented with the ice skate 1'. The ice skate 1' may include a skate boot 2' and a skate blade 3'. The skate blade 9' may include mounting hump(s) 9' for mounting the risers 16*a-d*. The boot 2' may include threaded openings formed in the bottom of the boot 1' for mounting through the slot(s) in the platform 12. Fastener 19*a* is shown as it may be mounted through opening 18*a* and into threaded opening 18*b*. Fastener 19*b* is shown as it may be mounted through opening 18*c* and into threaded opening 18*d*. In an example, the components and connections depicted in the figures may be used for operation with the ice skate 1'.

The blade mounting bracket 10 is adaptable to the skating gear or devices using blade mounting brackets such as blade mounting cups for speed skating. In an example, the mounting brackets 10 include slot holes of width less than 7 mm. This reduced size slots provides for a lower tolerance, and less opportunity for skate skid. In other words, it significantly reduces wiggling room of the fasteners inside the slot holes.

In another example, fastening washers may be provided to have more contact surface, especially in the area closely surrounding the bolt. This also increases effective friction with the surface 12 of the bracket 10, to better stabilize the mounting.

In an example, the set screws of bracket 10 reduce or altogether eliminate the vibration caused by the gap that would otherwise exist between the mounting leg of bracket and mounting humps of blade.

In an example, the bracket 10 provides loosening-resistant and continuously adjustable blade-boot mounting. The mounting position of the blade can be firmly secured during skating by the disclosed loosening-resistant mechanism. This results in improved skate performance which can increase skater confidence.

The bracket 10 may be fully compatible with existing boots and blades, to permit skaters to continue use existing gear such as boots and blades, and thus avoid costly equipment upgrades. The bracket 10 retains and enhances all skating or maneuvering abilities featured by original skating gear. The bracket 10 can be easily fitted to blades and boots of different brands. The bracket 10 may be provided for any combinations of blades and boots.

Advantages may include but are not limited to: elimination of loosened fastener-boot mounting caused by the configurations of the current mounting brackets, no costly gear upgrades or manufacturer retooling, applicability to any boot blade configurations using mounting bracket or mounting cup, and reduction of manufacturing cost with reduced tolerance.

The operations shown and described herein are provided to illustrate examples of attachment to an ice skate. It is noted that the operations are not limited to the ordering described above. Still other operations may also be implemented.

Figure 9:
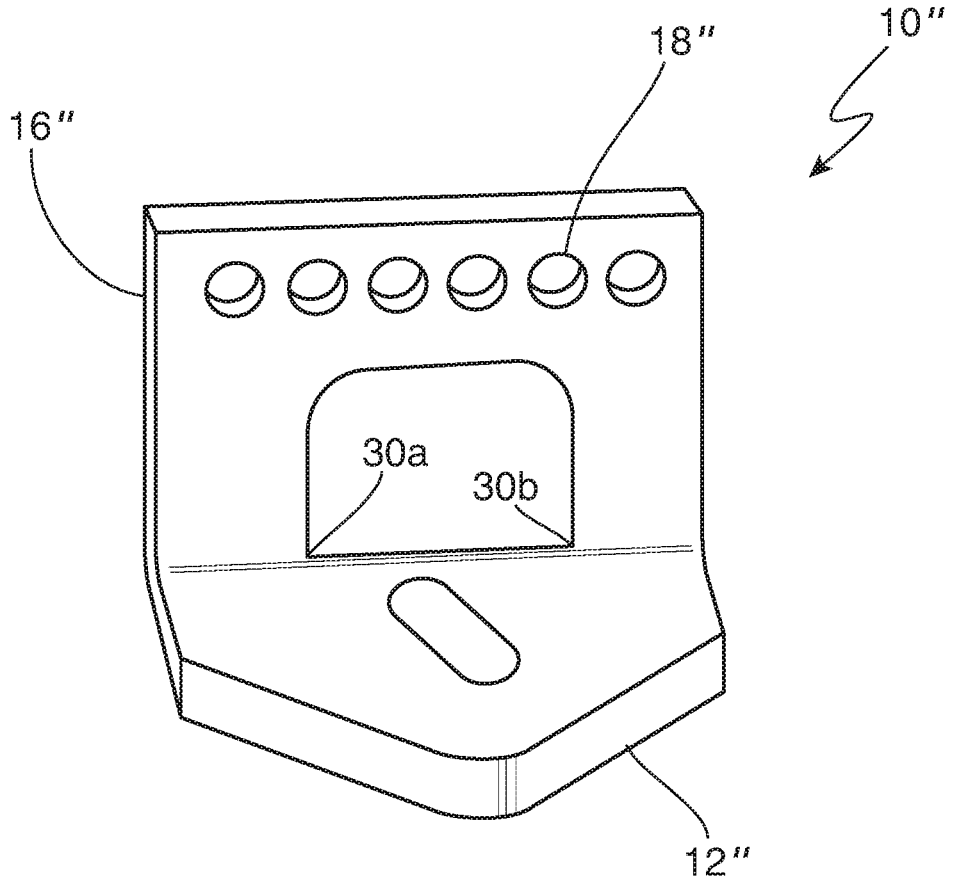
FIG. 9 is a perspective view of another example loosening-resistant blade mounting bracket.

FIG. 9 is a perspective view of another example loosening-resistant blade mounting bracket 10". The example loosening-resistant blade mounting bracket 10" is substantially T-shaped, having a single riser 16" on the platform 12". The single riser 16" connects with the platform 12 at separate connection points.

In the example shown in FIG. 9, the riser 16" has a plurality of openings 18" configured attach the riser 16" to the skate blade at multiple attachment points, making it fully adjustable. Although not shown in this example, set screws may also be provided.

It is noted that the examples shown and described are provided for purposes of illustration and are not intended to be limiting. Still other examples are also contemplated.

The invention claimed is:

1. A loosening-resistant blade mounting bracket, comprising:

a platform;

a slot formed in the platform with less than a 7 mm width, the slot configured to receive a first fastener therethrough for attaching the platform to the bottom of a boot;

at least one riser on the platform;

at least one opening formed in the at least one riser, the at least one opening configured to receive a second fastener therethrough for attaching the riser to a blade; and a set screw on the at least one riser, the set screw tightening through the at least one riser and against a mounting hump on the blade to reduce movement between the at least one riser and the mounting hump.

2. The loosening-resistant blade mounting bracket of claim 1, wherein the platform is substantially perpendicular to the at least one riser.

3. The loosening-resistant blade mounting bracket of claim 1, wherein the slot is substantially perpendicular to a longitudinal direction of the blade.

4. The loosening-resistant blade mounting bracket of claim 1, wherein the slot is diagonal relative to a longitudinal direction of the blade.

5. The loosening-resistant blade mounting bracket of claim 1, wherein the slot is formed substantially 45 degrees to a longitudinal direction of the blade.

6. The loosening-resistant blade mounting bracket of claim 1, further comprising another slot on the platform, both slots on the platform substantially parallel to one another.

7. The loosening-resistant blade mounting bracket of claim 1, further comprising a plurality of risers on the platform.

8. The loosening-resistant blade mounting bracket of claim 7, further comprising four risers on the platform, one riser on each corner of the platform.

9. The loosening-resistant blade mounting bracket of claim 7, wherein each of the plurality of risers has an opening configured to attach the riser to the blade.

10. The loosening-resistant blade mounting bracket of claim 7, wherein each of the plurality of risers has a set screw configured to tighten through the riser and against a mounting hump on the blade to reduce movement between the riser and the mounting hump.

11. The loosening-resistant blade mounting bracket of claim 1, further comprising a single riser on the platform.

12. The loosening-resistant blade mounting bracket of claim 11, wherein the single riser connects with the platform in at least two separate corners of the platform.

13. The loosening-resistant blade mounting bracket of claim 11, wherein the single riser has a plurality of openings configured attach the single riser to the blade at multiple attachment points.

14. A loosening-resistant blade mounting bracket for an ice skate, comprising:

a platform;

a slot formed in the platform, the slot configured to receive a first fastener therethrough for attaching the platform to the bottom of a skate boot;

at least one riser substantially perpendicular to the platform;

at least one opening formed in the at least one riser, the at least one opening configured to receive a second fastener therethrough for attaching the riser to a skate blade; and a set screw on the at least one riser, the set screw tightening through the at least one riser and against a mounting hump on the blade to reduce movement between the at least one riser and the mounting hump.

15. The loosening-resistant blade mounting bracket of claim 14, further comprising another slot on the platform, both slots on the platform substantially parallel to one another.

16. The loosening-resistant blade mounting bracket of claim 1, further comprising a plurality of risers on the platform, each of the plurality of risers having an opening configured to attach the corresponding one of the risers to the blade.

17. A loosening-resistant blade mounting bracket for an ice skate, comprising:

a platform having at least one slot configured to receive a first fastener therethrough for attaching the platform to the bottom of a skate boot;

at least one riser substantially perpendicular on the platform, the riser having at least one opening configured to receive a second fastener therethrough for attaching the riser to a skate blade; and a set screw on the at least one riser, the set screw tightening through the at least one riser and against a mounting hump on the blade to reduce movement between the at least one riser and the mounting hump.

18. The loosening-resistant blade mounting bracket of claim 17, further comprising another slot on the platform, both slots on the platform substantially parallel to one another.

19. A loosening-resistant blade mounting bracket, comprising:

a platform;

a slot formed in the platform with less than a 7 mm width, the slot configured to receive a first fastener therethrough for attaching the platform to the bottom of a boot;

at least one riser on the platform;

at least one opening formed in the at least one riser, the at least one opening configured to receive a second fastener therethrough for attaching the riser to a blade; and four risers on the platform, one riser on each corner of the platform.

20. A loosening-resistant blade mounting bracket, comprising:

a platform;

a slot formed in the platform with less than a 7 mm width, the slot configured to receive a first fastener therethrough for attaching the platform to the bottom of a boot;

at least one riser on the platform;

at least one opening formed in the at least one riser, the at least one opening configured to receive a second fastener therethrough for attaching the riser to a blade; and a plurality of risers on the platform, each of the plurality of risers having an opening configured to attach the riser to the blade.

21. A loosening-resistant blade mounting bracket, comprising:

a platform;

a slot formed in the platform with less than a 7 mm width, the slot configured to receive a first fastener therethrough for attaching the platform to the bottom of a boot;

at least one riser on the platform;

at least one opening formed in the at least one riser, the at least one opening configured to receive a second fastener therethrough for attaching the riser to a blade; and a plurality of risers on the platform, each of the plurality of risers having a set screw configured to tighten through the riser and against a mounting hump on the blade to reduce movement between the riser and the mounting hump.

22. A loosening-resistant blade mounting bracket, comprising:

a platform;

a slot formed in the platform with less than a 7 mm width, the slot configured to receive a first fastener therethrough for attaching the platform to the bottom of a boot;

at least one riser on the platform;

at least one opening formed in the at least one riser, the at least one opening configured to receive a second fastener therethrough for attaching the riser to a blade; and a single riser on the platform, the single riser connecting with the platform in at least two separate corners of the platform.

23. A loosening-resistant blade mounting bracket, comprising:

a platform;

a slot formed in the platform with less than a 7 mm width, the slot configured to receive a first fastener therethrough for attaching the platform to the bottom of a boot;

at least one riser on the platform;

at least one opening formed in the at least one riser, the at least one opening configured to receive a second fastener therethrough for attaching the riser to a blade; and a single riser on the platform, the single riser having a plurality of openings configured attach the single riser to the blade at multiple attachment points.

* * * * *